US010010921B2

(12) United States Patent
Abbasi

(10) Patent No.: US 10,010,921 B2
(45) Date of Patent: Jul. 3, 2018

(54) METHODS FOR BENDING THIN-WALLED TUBES

(71) Applicant: Hamid Reza Abbasi, Isfahan (IR)

(72) Inventor: Hamid Reza Abbasi, Isfahan (IR)

( * ) Notice: Subject to any disclaimer, the term of this patent is extended or adjusted under 35 U.S.C. 154(b) by 0 days.

(21) Appl. No.: 15/371,001

(22) Filed: Dec. 6, 2016

(65) Prior Publication Data

US 2018/0154415 A1 Jun. 7, 2018

(51) Int. Cl.
*B21D 9/01* (2006.01)
*B21D 37/18* (2006.01)

(52) U.S. Cl.
CPC ..... *B21D 9/01* (2013.01); *B21D 37/18* (2013.01)

(58) Field of Classification Search
CPC ... B21D 9/01; B21D 9/03; B21D 9/12; B21D 9/15; B21D 9/126; B21D 9/16; B21D 7/16; B21D 37/18
See application file for complete search history.

(56) References Cited

U.S. PATENT DOCUMENTS 2,971,556 A * 2/1961 Armstrong ..... B21D 9/03 72/42
4,450,886 A * 5/1984 Enomoto ..... B22D 19/0072 164/100
2003/0161966 A1* 8/2003 Bible ..... B21D 5/08 72/47
2004/0256095 A1* 12/2004 Yogo ..... B21D 9/03 166/55

* cited by examiner

*Primary Examiner* — Teresa M Ekiert

(57) ABSTRACT

A method for bending a thin-walled tube to form a small radius bend on the thin-walled tube includes providing a die, lubricating the thin-walled tube, extruding the thin-walled tube, and thrusting elastomer fillers. A die defining a curved cavity enclosed within is provided. The curved cavity is configured to receive the thin walled tube. The thin-walled tube is lubricated using an antifriction coating material applied on an exterior surface of the thin-walled tube for reducing friction between the exterior surface of the thin-walled tube and the curved cavity of the die. The thin-walled tube is extruded into a curved section from an insertion end of the die. The elastomer fillers are thrusted into an inner surface of the thin walled tube via a mandrel. The mandrel is forced against the thin-walled tube to prevent damage of the inner surface of the thin-walled tube to form the small radius bend.

6 Claims, 7 Drawing Sheets

METHODS FOR BENDING THIN-WALLED TUBES

BACKGROUND OF THE INVENTION

Tube bending has applications in various industries, for example, the automobile and aerospace industries. Existing aircraft require high strength-to-weight ratio of components to satisfy the aircraft's flight performance requirements. Modern aircraft have multiple tubing systems, for example, air-preparing system (APS), anti-icing system (AIS), air conditioning system (ACS), fuel system and separate elements, etc., made of especially thin-walled tubes of aluminum alloys, titanium alloys, and anti-corrosion steels. Therefore, thin-wall tube bending processes play an important role in the aircraft manufacturing process.

For thin-walled structures, especially the ultra-thin-wall tube produces buckling and fracture easily during bending processes. A tube bending method, which bends thin-wall tubes with small bend radii without causing buckling or fracture, is required. Traditionally, tube-bending processes, for example, rotary draw bending, roll bending, compressing bending, tube hydroforming, etc., are commonly used. Conventionally, bending thin-walled tubes with critical bend radius is done using sand. With this approach, numerous wrinkles are formed on the inner surface of the tube. Furthermore, the bending tubes and the pipe bending equipment are filled with sand. A tube bending method, which prevents the formation of wrinkles on the inner surface of the tube, is required.

Alternatively, the tubes are filled with molten bismuth. This method produces better quality tubes but causes many environmental problems. Due to weight restrictions and space limitations of an aircraft, use of thin-walled tubes of aluminum alloys, stainless steel, etc., is preferred in air conditioning systems of the aircraft.

Push bending method is an effective method with low production costs for bending thin-wall tubes with critical bend radius. Rotary-draw bending method is commonly used in the automotive industry. Rotary draw bending is a bending operation where the tube is wrapped around a radius block to form the required bend with or without a mandrel depending on cross section requirements. The main problems faced during the rotary-draw tube bending method, for example, are wrinkling, cross sectional distortion, and tube breakage.

The correct use of the process parameters would help to avoid or minimize these defects. The production of thin-wall tubes with a critical bend radius using this method requires computer numerical control (CNC) machines. This requirement further increases the cost of production. Similarly, hydroforming processes are also capable of producing small radii bends. However, hydroforming requires specialized equipment and hydraulic systems, which again reduces production efficiency. A tube bending method, which produces small radii bends economically and efficiently, is required. Moreover, a tube bending method, which applies a suitable frictional force on the tube to produce a well-formed tube, is required.

Hence, there is a long felt but unresolved need for a tube bending method, which bends thin-wall tubes with small bend radii without causing buckling or fracture. Moreover, there is a need for a tube bending method, which prevents the formation of wrinkles on the inner surface of the tube.

Furthermore, there is a need for a tube bending method, which creates minimal spring back in tubes.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The present method significantly reduces production costs, improves product quality, etc. Moreover, the present method provides a simple, quick, and high precision thin-walled tube bending process.

The method disclosed herein addresses the above-mentioned need for a tube bending method, which bends thin-wall tubes with small bend radii without causing buckling or fracture. The method has the advantages of efficiency, precision, low cost, and quality compared with conventional tube bending methods. Moreover, the method addresses the need for a tube bending method, which prevents the formation of wrinkles on the inner surface of the tube. Furthermore, the method addresses the need for a tube bending method, which creates minimal spring back in tubes. The method creates minimal spring back in tubes, and high quality use of three types of soft, semi hard, and hard rubbers in an arrangement during the process as disclosed in the detailed description. Overall, the present invention improves the pipe bending deformation, but also improves production efficiency and reduces the price of the final product.

A method for bending a thin-walled tube to form a small radius bend on the thin-walled tube comprises providing a die, lubricating the thin-walled tube, extruding the thin-walled tube, and thrusting elastomer fillers. A die defining a curved cavity enclosed within is provided. The curved cavity is configured to receive the thin walled tube. The thin-walled tube is lubricated using an antifriction coating material applied on an exterior surface of the thin-walled tube for reducing friction between the exterior surface of the thin-walled tube and the curved cavity of the die. The thin-walled tube is extruded into a curved section from an insertion end of the die. The elastomer fillers is thrusted into an inner surface of the thin walled tube via a mandrel. The mandrel is forced from an end distal to the insertion end of the die against the thin-walled tube to prevent damage of the inner surface of the thin-walled tube to form the small radius bend.

One aspect of the presently disclosed invention is a method for bending a thin-walled tube to form a small radius bend on the thin-walled tube, the method comprising: (a) providing a die defining a curved cavity enclosed within, wherein the curved cavity is configured to receive the thin walled tube; (b) lubricating the thin-walled tube, wherein an antifriction coating material is applied on an exterior surface of the thin-walled tube for reducing friction between the exterior surface of the thin-walled tube and the curved cavity of the die; (c) extruding the thin-walled tube into a curved section from an insertion end of the die, wherein the curved section is configured to form the small radius bend on the thin-walled tube; and (d) thrusting elastomer fillers into an inner surface of the thin walled tube via a mandrel, wherein the mandrel is forced from an end distal to the insertion end of the die against the thin-walled tube to prevent damage of the inner surface of the thin-walled tube to form the small radius bend.

In one embodiment, the elastomer fillers are selected from a group consisting of a hard rubber material, a semi-hard rubber material, and a soft rubber material. In another embodiment, the elastomer fillers are of a generally cylindrical configuration. In one embodiment, the damage of the inner surface of the thin-walled tube is formation of wrinkles on the inner surface of the thin-walled tube. In another embodiment, damage of the inner surface is cracking and a buckling of the inner surface of the thin-walled tube. In another embodiment, the elastomer fillers comprise hard rubber material, semi-hard rubber material, or soft rubber material. In another embodiment, lubricating the thin-walled tube further comprises degreasing the exterior surface of the thin-walled tube; anodizing the degreased exterior surface of the thin-walled tube; drying the anodized thin-walled tube; applying the antifriction coating material to the dried exterior surface of the thin-walled tube; and heating the thin-walled tube upon application of the antifriction coating material.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to tube bending. More particularly, the invention disclosed herein relates to a method for bending a thin-walled tube to form a small radius bend on the thin-walled tube.

Figure 1:
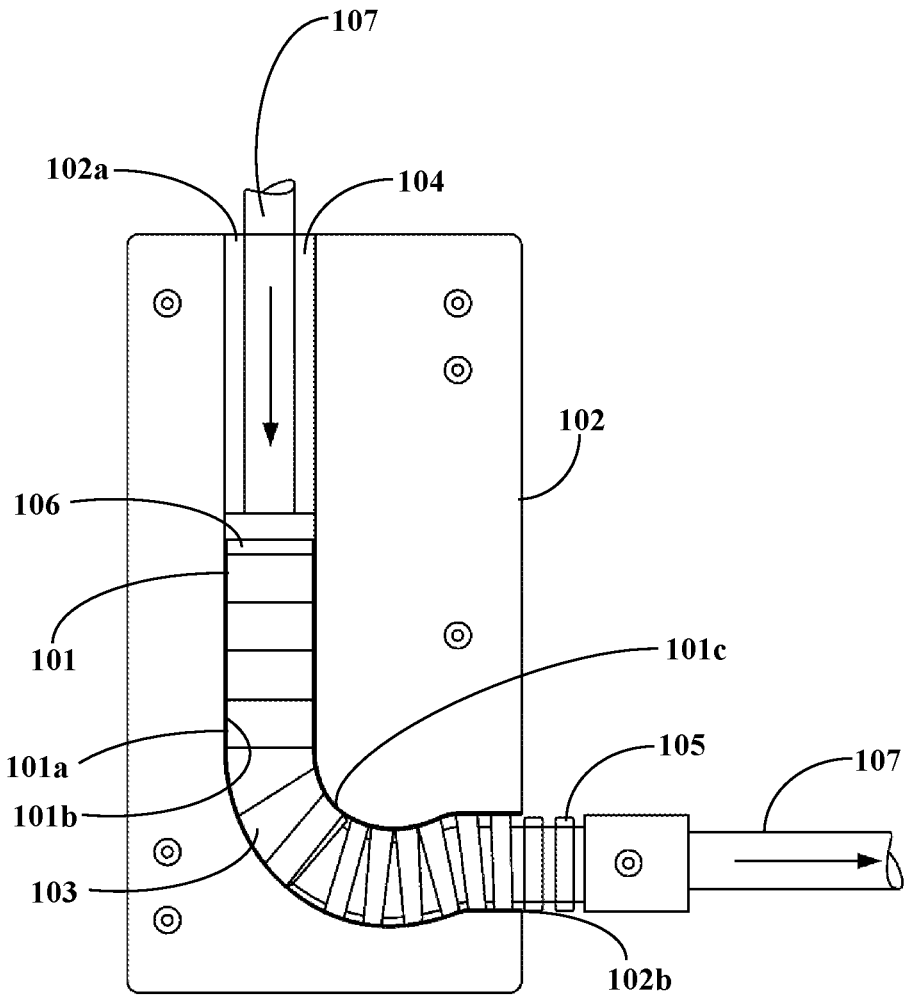
FIG. 1 exemplarily illustrates a right side sectional view of a die showing a thin-walled tube with a small bend radius push bended in the die.

FIG. 1 exemplarily illustrates a right side sectional view of the die 102 showing a thin-walled tube 101 with a small bend radius 101*c* push bended in a die 102. The method for bending a thin-walled tube 101 to form a small radius bend 101*c* on the thin-walled tube 101 comprises providing a die 102, lubricating the thin-walled tube 101, extruding the thin-walled tube 101, and thrusting elastomer fillers 103. A die 102 defining a curved cavity 104 enclosed within is provided. The curved cavity 104 is configured to receive the thin-walled tube 101. The thin-walled tube 101 is lubricated using an antifriction coating material applied on an exterior surface 101*a* of the thin-walled tube 101 for reducing friction between the exterior surface 101*a* of the thin-walled tube and the curved cavity 104 of the die 102. The thin-walled tube 101 is extruded into a curved section from an insertion end 102*a* of the die 102.

The elastomer fillers 103 is thrusted into an inner surface 101*b* of the thin-walled tube 101 via a mandrel 105. The mandrel 105 is forced from an end 102*b* distal to the insertion end 102*a* of the die 102 against the thin-walled tube 101 to prevent damage of the inner surface 101*b* of the thin-walled tube 101 to form the small radius bend 101*c*. The present method significantly reduces production costs, improves product quality, etc. Moreover, the present method provides a simple, quick, and high precision thin-walled tube 101 bending process.

Push bending process is one of the methods used to bend a small diameter thin-walled tube 101 with a small radius bend 101*c*, in which the thin-walled tube 101 is filled with elastomer fillers 103 and internal pressure is generated by squeezing the two exposed ends of the elastomer fillers 103. A flexible mandrel 105 is used at the end 102*b* of the thin-walled tube 101 and a plunger 106 at another end as exemplarily illustrated in FIG. 1.

In an embodiment, hydraulic cylinders 107 actuate both the plunger 106 and the mandrel 105 to generate the internal pressure. The squeezed elastomer fillers 103 are compressed in a longitudinal direction. This longitudinal compression causes the elastomer fillers 103 to expand in a radial direction and produces hydrostatic pressure within the thin-walled tube 101 during the bending process. The introduction of the elastomer fillers 103 prevents common defects in the tube bending process, for example, wrinkling on the inner surface of the thin-walled tubes 101, tearing and/or thinning of the outer side of the bend zone, upsetting and buckling in the straight part of the tubes, etc. In the next step, the thin-walled tube 101 filled with elastomer fillers 103 is pushed by the hydraulic cylinders 107.

The pressure on the elastomer fillers 103 is maintained, in one example, by the mandrel 105. On removing the pressure exerted, the elastomer fillers 103 return to their original size, are taken out of the thin-walled tube 101 at the end the process, and are usable for the next cycle.

Figure 2:
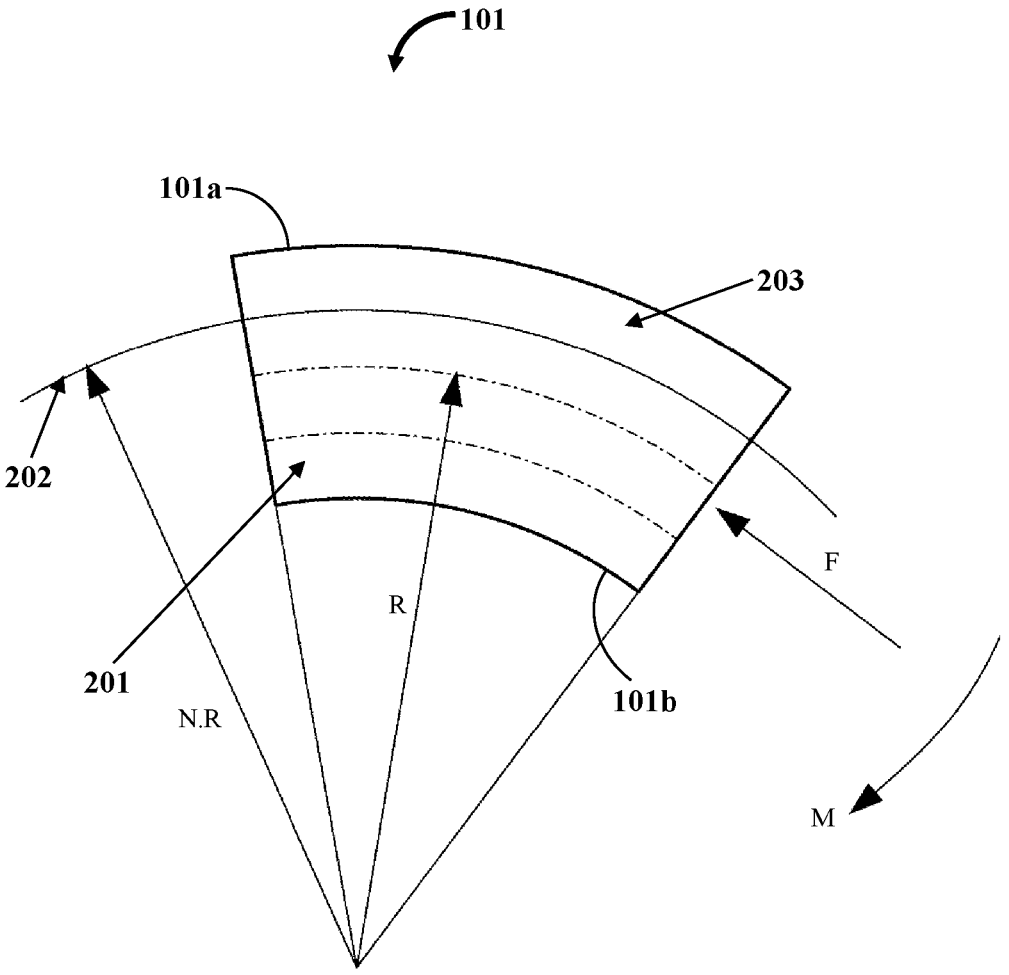
FIG. 2 exemplarily illustrates a view of a stress distribution of a cross-section at a bend zone of the thin-walled tube.

FIG. 2 exemplarily illustrates a view of a stress distribution of a cross-section at a bend zone of the thin-walled tube 101. As exemplarily illustrated in FIG. 2, "M" refers to the bending moment and "N.R" refers to the bend radius of the neutral layer. It is seen that an extra axial compressive stress, resulting from the interaction between the push force and the friction force, makes the neutral layer to have an excursion in the outside direction, which is beneficial for decreasing the wall thickness reduction. In an embodiment, a compression zone 201, a tension zone 203, and a neutral axis 202 of a thin-walled tube 101 are exemplarily illustrated in FIG. 2. As used herein, neutral axis 202 of the thin-walled tube 101 refers to an axis in the cross section of the thin-walled tube 101 along which there are no longitudinal stresses or strains.

The zone between the neutral axis 202 and the exterior surface 101*a* of the thin-walled tube 101 is termed as the tension zone 203. Additionally, the zone between the neutral axis 202 and the inner surface 101*b* of the thin-walled tube 101 is termed as the compression zone 201. During the push bending process, the neutral axis 202 of the thin-walled tube 101 transfers to the tension zone 203 of the thin-walled tube 101 exemplarily illustrated in FIG. 2. As a result, a large area of the cross section of the thin-walled tube 101 is under pressure and hence reduction of the wall thickness is much less than other methods.

Figure 3:
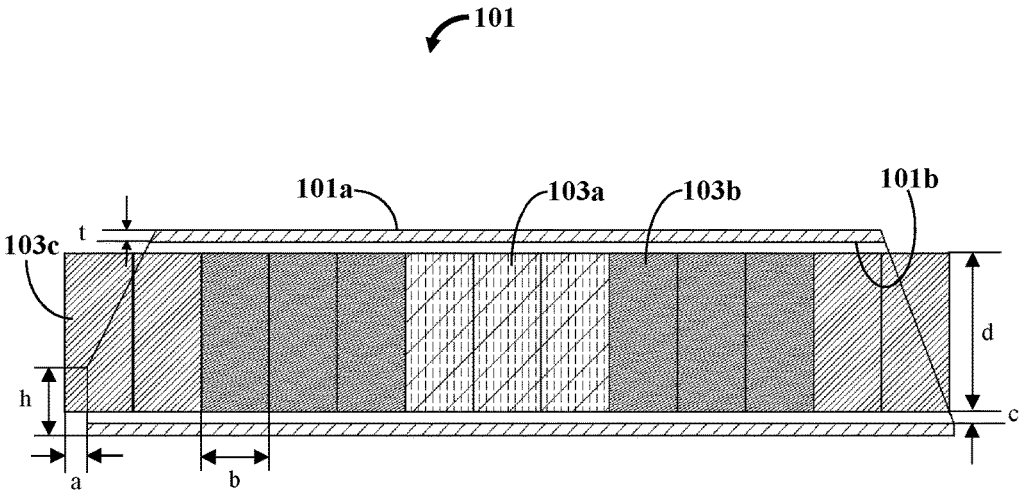
FIG. 3 exemplarily illustrates a cross-sectional view of an arrangement of elastomer fillers in a thin-walled tube undergoing a push bending process.

FIG. 3 exemplarily illustrates a cross sectional view of an arrangement of elastomer fillers 103 in a thin-walled tube 101 undergoing a push bending process. In an embodiment, the elastomer fillers 103 are, for example, soft rubber material 103*a*, semi-hard rubber material 103*b*, and hard rubber material 103*c* as exemplarily illustrated in FIG. 3. The parameters shown in FIG. 3 are t=thickness, c=clearance, b=width, d=diameter, h=0.25×D.

As previously discussed, the thin-walled tube 101 is manufactured from various materials, for example, alloys of aluminum, titanium, corrosion resistant steel (cress), etc. In an embodiment, bending of a thin-walled 6061 aluminum alloy pipe is disclosed. In FIG. 3, the thin-walled tube 101 has a wall thickness t and inside diameter d. The elastomer fillers 103 are used to fill the thin-walled tube 101 and prepare the thin-walled tube 101 for bending. The elastomer fillers 103 on the ends of the thin-walled tube 101 are the hard rubber material 103*c*. The soft rubber material 103*a* is positioned in the middle of the thin-walled tube 101 and the semi-hard rubber material 103*b* with medium hardness is positioned between the hard rubber materials 103*c* and the soft rubber material 103*a*. In an embodiment, multiple pieces of each elastomer filler 103 are used, where each piece has a generally cylindrical configuration with a thickness b as exemplarily illustrated in FIG. 3.

In an embodiment, each piece of elastomer filler 103 has a diameter d, which is slightly smaller than inside diameter d of the thin-walled tube 101, such that a clearance gap c is created between the elastomer fillers 103 and the thin-walled tube 101. A total length of the elastomer fillers 103 may be slightly longer than the length of the thin-walled tube 101 and therefore a piece may protrude out from the thin-walled tube 101. During the bending process, the soft rubber material 103*a* behaves like a fluid and flow towards the ends. However, the hard rubber materials 103*c* prevent the soft rubber material 103*a* to extrude out of the thin-walled tube 101. The semi-hard rubber material 103*b* transfers the pressure from the hard rubber materials 103*c* to the soft rubber materials 103*a*.

Vinyl chloride is used, in one example, as a semi-hard elastomer filler 103 as it is a resin with high elastic memory. This resin may have a hardness between 55 and 80 on a "Shore D" hardness scale. The modulus of elasticity of the medium type elastomer ranges between 15,000 and 25,000 per square inch (psi). Depending on the skill level of an operator performing the tube bending, this type of semi-hard elastomer filler 103 is reused for about 200 to 400 cycles of the tube bending process. The soft elastomer filler 103 has high compressibility property. In an embodiment, the soft elastomer filler 103 is made from materials, for example, natural rubber, synthetic rubber, poly sulphide rubber, etc.

The poly sulphide rubber has a variable hardness between 5 and 85 on a "Shore A" hardness scale. The modulus of elasticity of poly sulphide is approximately 0.0025 times the modulus elasticity of the medium elastomer. This elastomer filler 103 is reused in about 1000 to 2000 cycles of tube bending process. However, if the medium type elastomer filler 103 is used throughout the thin-walled tube 101, the life of the elastomer filler 103 is limited to 3 to 10 bending cycles. In addition, it is noted that the modulus elasticity of the medium type elastomer is a function of the ratio of the diameter to the thickness of the elastomer filler 103. The lower the ratio is, the higher the modulus elasticity of the medium type elastomer filler 103 may be.

Each piece of elastomer filler 103 may be resistant to the repeated attrition during the bending cycles. Therefore, sponge type elastomers may not be a suitable elastomer filler 103 for this purpose because the sponge elastomers tend to tear during the bending process due to uneven attrition forces in different parts of the elastomer fillers 103. Therefore, porous elastomer types may not be suitable as elastomer fillers 103 during tube bending processes. The hard elastomer filler 103 at both ends of the thin-walled tube 101 may be under direct pressure from the hydraulic cylinders 107 on one end and the mandrel 105 on the other end of the thin-walled tube 101 exemplarily illustrated in FIG. 1.

In an embodiment, the hard elastomer fillers 103 are made from poly-vinyl chloride (PVC). The number of pieces of elastomer fillers are different based on the length of the thin-walled tube 101. The multi piece elastomer fillers 103 have a longer life compared to a one-piece elastomer filler 103 and can be used repeatedly for extended lengths of time. The clearance gap c between the elastomer fillers 103 and the thin-walled tube 101 wall is determined based on the elastomer filler 103 types. In fact, the value of clearance gap c is different for each elastomer filler 103 type, for example, hard, soft, medium, etc.

In the case of hard and medium type elastomers, if the value of clearance gap c is too small, the pressure from hydraulic the hydraulic cylinders 107 and the mandrel 105 are not transferred to the soft elastomer filler 103 in the middle. This may cause wrinkling of the thin-walled tube 101 at the position of the small radius bend 101*c* exemplarily illustrated in FIG. 1. On the other hand, if the value of clearance gap c is too large, the soft elastomer filler 103 may not expand or buckle due to the pressure and instead the soft elastomer filler 103 tends to extrude and flow out from the thin-walled tube 101. In this case, too, the thin-walled tube 101 is wrinkled because the pressure cannot be transferred to the small radius bend 101*c* location.

In the case of soft elastomer fillers 103, if the value of clearance gap c is too low, the pressure transfer may be desirable, however, upon completion of the bending process, removing the elastomer filler 103 from the thin-walled tube 101 may be very difficult. However, a too high clearance gap c may cause the pressure force to be spent on expanding the diameter of the soft elastomer filler 103. In this case, the pressure is not transferred to the thin-walled tube 101 and causes wrinkling of the thin-walled tube 101.

Experimental results show that the total length of the elastomer fillers 103 need to be slightly longer than the length of the thin-walled tube 101 such that the hard elastomer protrudes out from the thin-walled tube 101. The protruding portion of hard elastomer filler 103 from the thin-walled tube 101 is shown in FIG. 3 as the dimension 'a'.

The reason for protruding length 'a' is that elastomer fillers 103 typically retract under pressure and may retract inward inside the thin-walled tube 101 for up to 20 millimeters on each side. If the protrusion value 'a' is too large, the hard elastomer filler 103 may buckle and give way under pressure, however, if the protrusion value 'a' is too small, the elastomer filler 103 may retract to the point that a pressure from the hydraulic cylinders 107 cannot reach the elastomer filler 103.

In addition, retraction of the elastomer fillers 103 inside the thin-walled tube 101 makes removal of the elastomer fillers 103 from the thin-walled tube 101 at the end of bending process difficult. The experimental results show that the optimal value for the protrusion value 'a' ranges between 3 to 4 millimeters. In an embodiment, the elastomer fillers 103 consist of individual cylindrical shaped elastomer fillers 103 laid out inside the thin-walled tube 101. In cases when a wrinkling occurs on the thin-walled tube 101 during the bending process, removing the individual pieces of elastomer fillers 103 from the thin-walled tube 101 becomes problematic. In order to prevent such problems, a small opening is created in the center of each disk-shaped elastomer filler 103. A thin wire with a diameter slightly smaller than the opening runs through the openings of the disk-shaped elastomer fillers 103 and thread the elastomer fillers 103 together. A thin metal disk with a diameter smaller than the diameter of elastomer fillers 103 is placed next to the last elastomer filler 103 on one end of the thin-walled tube 101 and one end of the wire can be tied to the metal disks. The other end of the wire is left untied. Upon completion of the bending process, the elastomer fillers 103 are removed from the thin-walled tube 101 by pulling the untied end of the wire.

In an embodiment, the diameter of the opening on the disk-shaped elastomer is about 2 millimeters and the diameter of the wire is slightly less than the diameter of the opening. The threading of the elastomer fillers 103, as discussed, prevents the elastomer fillers 103 from being trapped inside the thin-walled tube 101. In addition, the elastomer fillers are used repeatedly for other bending processes for similar thin-walled tubes 101 without a need for the elastomer fillers 103 to be repeatedly laid out inside the thin-walled tube 101 individually. When the elastomer fillers 103 are laid out next to each other, a layer of fireproof oil or grease are applied on the touching surfaces of the consecutive disk-shaped elastomer fillers 103. The grease creates adhesion between the elastomer fillers 103. The outer surface of the elastomer fillers 103 touching the thin-walled tube 101 are also greased. If no grease is applied, a high friction may be generated between the elastomer fillers 103 and the thin-walled tube 101 and the friction reduces the pressure inside the thin-walled tube 101. The reduced pressure may affect the bending process by causing wrinkles in the thin-walled tube 101. The degree of roughness of the surface of each elastomer filler 103 affects the bending process.

According to the experiments performed, the optimum value of the arithmetic average of absolute values of collected roughness data points (Ra factor) may be from 0.5 to 0.6. ($0.5 \leq Ra \leq 0.6$). As an example, for an aluminum thin-walled tube 101, if a one piece soft elastomer filler 103 with a hardness 85 in "Shore A" scale is used, the bending process causes damages to the thin-walled tubes 101 on both ends. The advantage of the soft elastomer filler 103 with hardness 85 "Shore A" is that this elastomer filler 103 maintains hydrostatic pressure throughout the thin-walled tube 101, even in the stretched area at the small radius bend 101*c* such that the thin-walled tube 101 is not separated from the mold. Therefore, the small radius bend 101*c* can be maintained during the bending process.

As another example, for the aluminum thin-wall pipe, if a one piece hard elastomer filler 103 with a hardness 75 in "Shore D" scale is used, the elastomer filler 103 loses pressure at the small radius bend 101*c* location and as a result, the thin-walled tube 101 separates from mold and the thin-walled tube 101 may be flattened. However, the advantage of the hard elastomer filler 103 with hardness 75 "Shore D" is that this elastomer filler 103 may not cause damage to the ends of the thin-walled tubes 101.

Therefore, a soft elastomer filler 103 maintains circular shape of the cross-section of the thin-walled tube 101 at the small radius bend 101*c* location and a hard elastomer filler 103 can prevent damage at both ends of the pipe. Multi-piece elastomer fillers are beneficial in reducing or eliminating damages to the thin-walled tube 101 during the bending process. However, bends with various degrees may require adjustment of elastomer filler 103 types based on calculating various factors, for example, friction factor, etc. Simulation and experimental results indicate that the friction coefficient between the thin-walled tube 101 and the mold must be within a certain range, such that the thin-walled tube 101 can be bent without defects.

The friction coefficient in the feeding section of the mold must be as low as possible so that collapse may not appear in the head of the thin-walled tube 101. If friction coefficient in the elbow section is very low, the thickness in the stretch zone may be so thin that wrinkling may appear in the compression zone exemplarily illustrated in FIG. 2. Conversely, if friction coefficient in the elbow section is very high, the wrinkling may still appear in the compression zone. In an embodiment, the friction conditions in the bending zone are optimized to suitable friction condition. For example, if the aluminum pipe is covered with a solid lubricant and the surface of the feed section is finished with a machine tool or hand polishing, and the elbow section is finished just in the machining operation, the range of proper friction can be obtained.

Figure 4A:
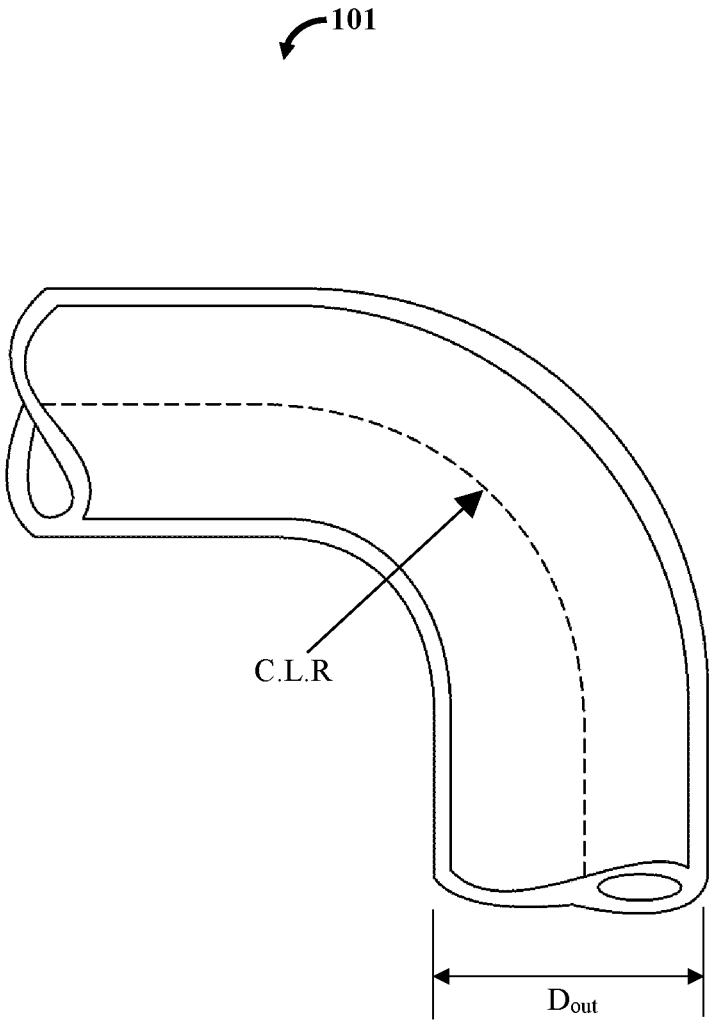
FIG. 4A exemplarily illustrates bending design factors of the thin-walled tube.
Figure 4B:
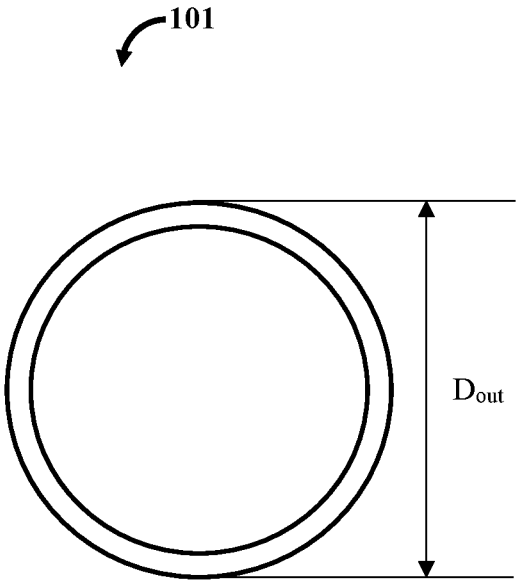
FIG. 4B exemplarily illustrates bending design factors of the thin-walled tube.

FIGS. 4A-4B exemplarily illustrates bending design factors of the thin-walled tube 101. The D of bend factor of a thin-walled tube 101 can be calculated when the centerline radius and the outside diameter of the thin-walled tube 101 is known. When the thin-walled tube 101 is bent with a center line radius (C.L.R) as exemplarily illustrated in FIG. 4A, the D of bend can be calculated using the equation D of bend=C.L.R/$D_{out}$. For example, the disclosed method can be used for bending the 6061 aluminum alloy thin-walled tube 101 in critical conditions that has a D of bend between 1 and 2 ($1 \leq$ D of bend$\leq 2$). FIG. 4B exemplarily illustrates a bottom view of the thin-walled tube 101. $D_{out}$ represents the outside diameter of the thin-walled tube 101. The wall factor of the thin-walled tube 101 can be calculated using the equation Wall factor=$D_{out}$/wall thickness.

Figure 5:
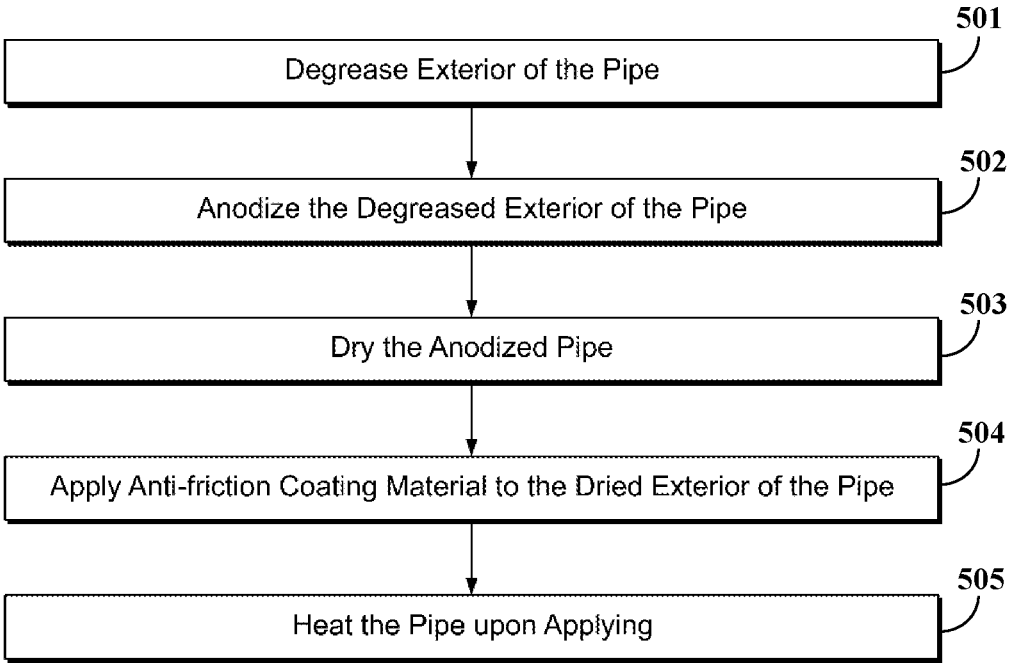
FIG. 5 exemplarily illustrates a method for lubricating a thin-walled tube.

FIG. 5 exemplarily illustrates a method for lubricating a thin-walled tube 101. In order to reduce friction, a process for lubricating a thin-walled tube 101 for press bending is exemplarily illustrated in FIG. 5. In an embodiment, a solid lubricant is used for lubricating the exterior surface 101*a* of the thin-walled tube 101 prior to placing the thin-walled tube 101 in the die 102 as exemplarily illustrated in FIG. 1.

Additionally, the curved cavity 104 is coated with a material different from the material the thin-walled tube 101 is made from. For example, when the thin-walled tube 101 is made from aluminum, the interior of the curved cavity 104 is made from steel, for example, M2 steel, etc. Application of a solid lubricant on the exterior surface 101*a* of the thin-walled tube 101 and coating the die 102 with steel material causes the friction factor between the thin-walled tube 101 and the die 102 to reduce. A reduced friction factor prevents the thin-walled tube 101 from stretching and breaking during the bending process. In an embodiment, for an aluminum pipe (e.g., aluminum 6061) Molybdenum disulfide ($MoS_2$) is used as the solid lubricant. First, the pipe/thin-walled tube 101 is degreased 501.

Upon degreasing, the pipe/thin-walled tube 101 is anodized 502. The process of anodization prepares the exterior surface 101*a* of the pipe/thin-walled tube 101 prior to the solid lubricant application. Anodizing is a process that provides a conversion on aluminum, which changes the surface of the material to a naturally occurring aluminum oxide. The oxide build up changes the surface of the aluminum, which then provides greater abrasion resistance as well as increased corrosion protection. For example, Sulfuric Acid anodization can be performed according to the "MIL-A-8625 Type II Class I" standard. Upon anodization, the pipe/thin-walled tube 101 is dried 503 in a dryer device, for example, using a fan, etc. The pipe/thin-walled tube 101 is coated 504 with an anti-friction material, for example, Molybdenum disulfide solid lubricant. The solid lubricant prevents corrosion, increases chemical resistance of the aluminum, and decreases friction between the pipe/thin-walled tube 101 and the die exemplarily illustrated in FIG. 1.

Upon application of the antifriction coating on pipe/thin-walled tube 101, the pipe/thin-walled tube 101 is heated 505. According to the standards, for an aluminum pipe upon application of anti-friction coating, the thin-walled tube 101 is heated to around (200±15) degrees centigrade for about 30 minutes. The anti-friction coating covers the thin-walled tube 101 with a thickness of 0.005 to 0.013 mm. In some cases, upon application of solid lubricant on the thin-walled tube 101 and prior to placing the thin-walled tube 101 in the die 102, a liquid lubricant, for example, corn oil, etc., is applied on the thin-walled tube 101.

Figure 6:
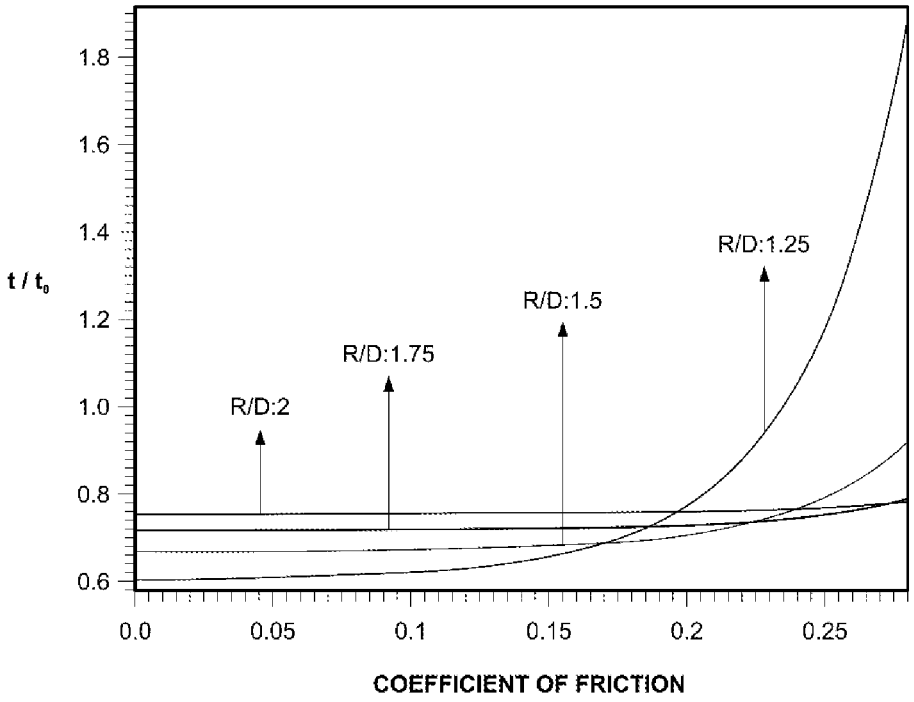
FIG. 6 exemplarily illustrates a graphical representation of the relative thickness ($t/t_o$) in the outer wall of the thin-walled tube versus coefficient of friction between the tube and the bending mold.

FIG. 6 exemplarily illustrates a graphical representation of the relative thickness ($t/t_o$) in the outer wall of the thin-walled tube 101 versus coefficient of friction between the thin-walled tube 101 and the bending die 102. FIG. 6 shows that by increasing the friction between the thin-walled tube 101 and the surface of elbow section, the thickness of the outer wall of bend will be increased. In addition, the rate of increasing the thickness is grown by reducing the D of Bend disclosed in the detailed description of FIG. 4. Therefore, it is possible to bend the thin-walled tube 101 with a very low D of Bend ($1 \leq R/D \leq 2$) without any tearing or thinning in the outer zone of the bend under a suitable friction condition.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A method for bending a thin-walled tube to form a small radius bend on the thin-walled tube, the method comprising:

(a) providing a die defining a curved cavity enclosed within, wherein the curved cavity is configured to receive the thin walled tube;

(b) lubricating the thin-walled tube comprising: degreasing the exterior surface of the thin-walled tube; anodizing the degreased exterior surface of the thin-walled tube; drying the anodized thin-walled tube; applying an antifriction coating material comprising molybdenum disulfide to the dried exterior surface of the thin-walled tube for reducing friction between the exterior surface of the thin-walled tube and the curved cavity of the die and heating the thin-walled tube upon application of the antifriction coating material;

(c) extruding the thin-walled tube into a curved section from an insertion end of the die, wherein the curved section is configured to form the small radius bend on the thin-walled tube; and (d) thrusting elastomer fillers into an inner surface of the thin walled tube via a mandrel, wherein the mandrel is forced from an end distal to the insertion end of the die against the thin-walled tube to prevent damage of the inner surface of the thin-walled tube to form the small radius bend.

2. The method of claim 1, wherein the elastomer fillers are selected from a group consisting of a hard rubber material, a semi-hard rubber material, and a soft rubber material.

3. The method of claim 1, wherein the elastomer fillers are of a generally cylindrical configuration.

4. The method of claim 1, wherein the damage of the inner surface of the thin-walled tube is formation of wrinkles on the inner surface of the thin-walled tube.

5. The method of claim 1, wherein the damage of the inner surface is cracking and a buckling of the inner surface of the thin-walled tube.

6. The method of claim 1, wherein the elastomer fillers comprise hard rubber material, semi-hard rubber material, or soft rubber material.

* * * * *